US011070000B2

(12) United States Patent
Song et al.

(10) Patent No.: US 11,070,000 B2
(45) Date of Patent: Jul. 20, 2021

(54) MAGNETIC POWER CONNECTION

(71) Applicant: International Business Machines Corporation, Armonk, NY (US)

(72) Inventors: Tao Song, Shenzhen (CN); XiYuan Yin, Guangzhou (CN); Qiuyi Yu, Shenzhen (CN); Hui Jin, Shenzhen (CN); Xin Ni Wang, Ningbo (CN); Jun Hu, Shenzhen (CN)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/691,643

(22) Filed: Nov. 22, 2019

(65) Prior Publication Data

US 2021/0159628 A1 May 27, 2021

(51) Int. Cl.
*H01R 11/30* (2006.01)
*H01R 13/453* (2006.01)
*H01R 13/11* (2006.01)

(52) U.S. Cl.
CPC ..... *H01R 13/4534* (2013.01); *H01R 13/11* (2013.01)

(58) Field of Classification Search
CPC ..... H01R 13/6205; H01R 23/7005; H01R 13/631; H01R 13/193
USPC ..... 439/39, 38, 378, 374, 342
See application file for complete search history.

(56) References Cited

U.S. PATENT DOCUMENTS 3,363,214 A 1/1968 Wright
3,521,216 A 7/1970 Tolegian
3,786,391 A 1/1974 Mathauser
7,425,132 B2 9/2008 Yang et al.
7,566,224 B2 7/2009 Wu
7,874,844 B1 1/2011 Fitts, Jr.
8,435,041 B2 5/2013 Holland
8,796,990 B2 8/2014 Paparo et al.
9,225,126 B2 12/2015 Janfada et al.
2006/0051981 A1* 3/2006 Neidlein ..... H01R 13/6205 439/39
2007/0293059 A1 12/2007 Yang et al.
(Continued)

FOREIGN PATENT DOCUMENTS

CA 2775681 A1 10/2013
CN 2473778 Y 1/2002
(Continued)

OTHER PUBLICATIONS

Redline Magnetic, "MEO the Magnetic Electrical Outlet," 2019, 22 pages http://redlinemagnetic.com/.
(Continued)

*Primary Examiner* — Phuong Chi Thi Nguyen
(74) *Attorney, Agent, or Firm* — Alex Harvey

(57) ABSTRACT

An electrical socket includes a magnet connected to a shield. The shield blocks access to receptacles of the socket when the magnet is at a rest position but moves away and allows access to the receptacles when the magnet is moved away from its rest position. The magnet is attached to a spring so that the spring pulls the magnet toward the rest position. A plug includes a plug magnet to attract the socket's magnet. When the plug is brought close to the socket, the socket magnet is pulled away from the rest position, moving the shield away and allowing the plug to be inserted.

16 Claims, 10 Drawing Sheets

(56) References Cited

U.S. PATENT DOCUMENTS

| | | | |
|---|---|---|---|
| 2009/0027873 | A1 | 1/2009 | Tarlton |
| 2011/0204845 | A1 | 8/2011 | Paparo et al. |
| 2012/0295457 | A1 | 11/2012 | Holland |
| 2013/0033224 | A1 | 2/2013 | Raedy |
| 2013/0229148 | A1 | 9/2013 | Khan et al. |
| 2019/0027873 | A1 | 1/2019 | Giampi |

FOREIGN PATENT DOCUMENTS

| | | | |
|---|---|---|---|
| CN | 2615901 | Y | 5/2004 |
| CN | 2715385 | Y | 8/2005 |
| CN | 201298627 | Y | 8/2009 |
| CN | 202172188 | U | 3/2012 |
| CN | 102810777 | B | 2/2015 |
| CN | 103199378 | B | 12/2015 |
| DE | 19853719 | A1 | 6/2000 |
| EP | 2461429 | A1 | 6/2012 |
| WO | 2017041317 | A1 | 3/2017 |

OTHER PUBLICATIONS

Rosenberger, "Magnetic Self-Mating Locating Connectors," Printed Jun. 4, 2019, 3 pages https://www.rosenberger.com/en/products/medical/magnetic.php.

* cited by examiner

MAGNETIC POWER CONNECTION

BACKGROUND

The present disclosure relates to cable connectors, and more specifically, to power cable plugs and sockets.

Many power connection standards require safety features to prevent accidental shock. These features may be implemented in the plug, the socket, or both. Many power plugs require substantial force to connect or disconnect to/from a corresponding socket, which can lead to wear and tear on both the plug and the socket over time. Degradation of the plug or socket over time can result in problems such as loose plugs, poor connections, and failure of safety features.

SUMMARY

Some embodiments of the present disclosure can be illustrated as an apparatus. The apparatus may comprise a socket including one or more receptacles and a shield. The shield may be moved between a first shield position and a second shield position. When the shield is in the first shield position, it may at least partially cover at least one receptacle. When the shield is in the second shield position, it may not cover any receptacles. The shield may be biased towards the first shield position. The socket may further comprise a socket magnet. The socket magnet may be operably coupled to the shield, and the socket magnet may be moved between a first socket magnet position and a second socket magnet position. Moving the socket magnet to the first socket magnet position may result in moving the shield to the first shield position. Moving the socket magnet to the second socket magnet position may result in moving the shield to the second magnet position. The socket magnet may be biased towards the first socket magnet position.

Some embodiments of the present disclosure can be illustrated as a plug apparatus. The plug apparatus may comprise one or more electrically conductive prongs and a plug magnet having a first polarization.

Some embodiments of the present disclosure can be illustrated as a system. The system may comprise a socket and a plug. The socket may include one or more receptacles and a shield. The shield may be moved between a first shield position and a second shield position. When the shield is in the first shield position, it may at least partially cover at least one receptacle. When the shield is in the second shield position, it may not cover any receptacles. The shield may be biased towards the first shield position. The socket may further comprise a socket magnet. The socket magnet may be operably coupled to the shield, and the socket magnet may be moved between a first socket magnet position and a second socket magnet position. Moving the socket magnet to the first socket magnet position may result in moving the shield to the first shield position. Moving the socket magnet to the second socket magnet position may result in moving the shield to the second magnet position. The socket magnet may be biased towards the first socket magnet position. The plug may include one or more prongs, where the prongs may conductively couple with contacts of the receptacles. The plug may further include a plug magnet, where the plug magnet may be magnetically attracted to the socket magnet when the plug is inserted into the socket.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and are not intended to limit the disclosure. Features and advantages of various embodiments of the claimed subject matter will become apparent as the following Detailed Description proceeds, and upon reference to the drawings, in which like numerals indicate like parts, and in which:

Figure 1A:
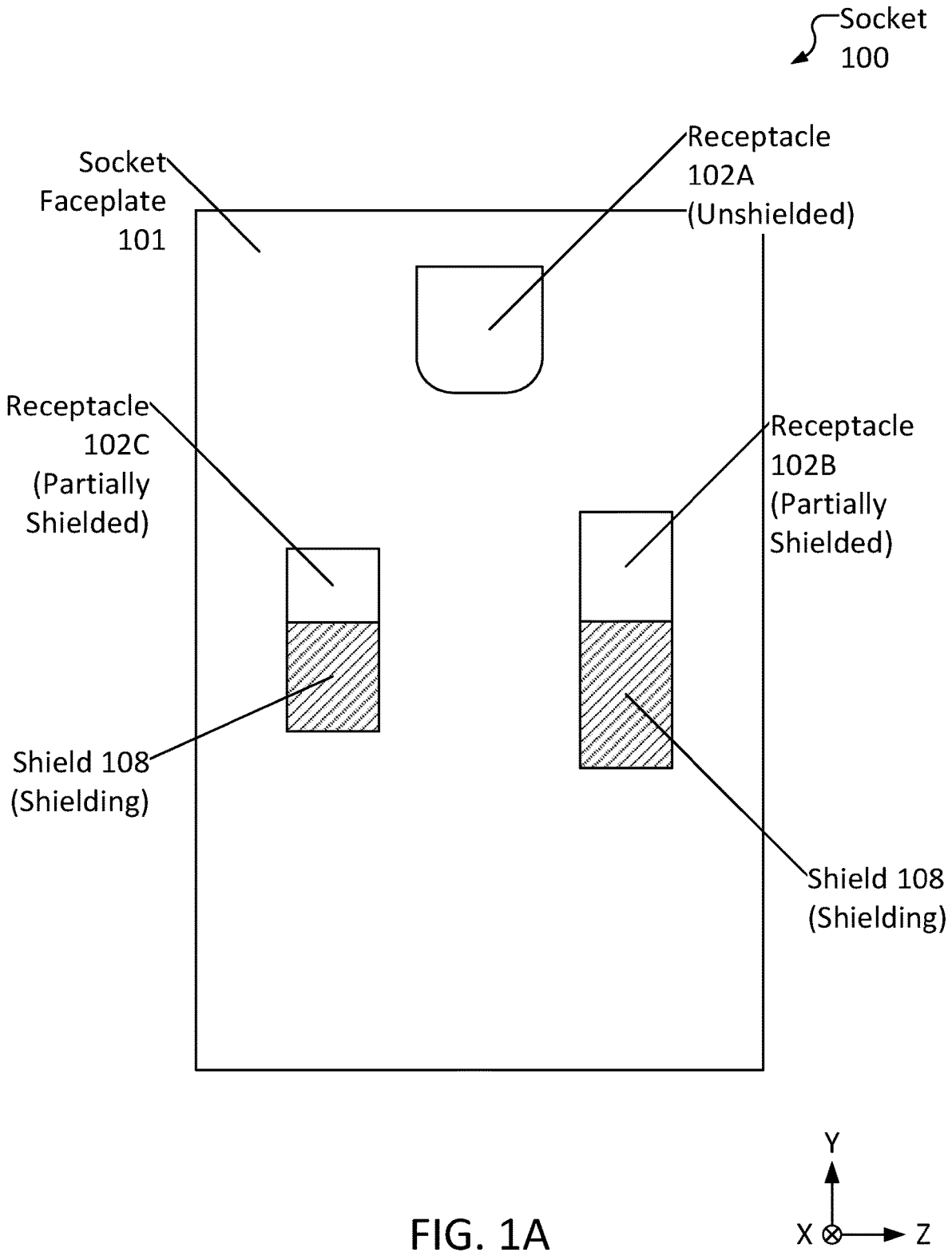
FIG. 1A illustrates a front view of a magnetic power socket in an unplugged and shielded (or "safe") state consistent with several embodiments of the present disclosure.

While this disclosure is amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Aspects of the present disclosure relate to a magnetic power plug and socket system. More particular aspects relate to a system including a socket having a shield to cover at least a live wire receptacle, the shield operably coupled to a magnet. The magnet may be coupled to a first spring such that the magnet is biased into a first position, wherein when the magnet is in the first position, the shield is engaged to cover the live wire receptacle.

Throughout this disclosure, reference is made to power "plugs" and "sockets." As used herein, a power plug refers to a "male" end of a power cable, typically including one or more "prongs" configured to be inserted into a "socket." As used herein, a "socket" includes one or more "receptacles" to receive the prongs of the plug. The "socket" also includes a "shield," where the shield prevents unwanted objects from accessing at least one of the receptacles.

Throughout this disclosure, reference is made to "receptacles." As used herein, a "receptacle" may refer to a component of a socket configured to receive a prong of a plug. A "receptacle," as used herein, includes a conductive contact and a negative space to allow physical insertion of a prong of a plug. The act of inserting a plug into a socket (or "plugging in" the plug) includes inserting prongs of the plug into receptacles of the socket, allowing the conductive contacts to conduct electricity. For example, many power sockets in North America typically include three receptacles; a "hot" receptacle, a "neutral" receptacle, and a "ground" receptacle. Some sockets omit one of these receptacles, typically the "ground" receptacle. Some power plugs (and some sockets) include additional receptacles. Power connectors (including plugs and sockets) typically comply with one or more standards, such as, for example, the United States National Electrical Manufacturers Association (NEMA).

In a typical plug and socket, the contacts of a receptacle are, at rest, in a "clamped" state wherein they are biased inwardly toward one another. Thus, insertion of a plug causes the contacts of typical receptacles to bend outward, which they resist. The plug is retained within the socket via a clamping/friction effect that resists insertion of the plug in a similar manner as it resists removal of the plug. Contacts of receptacles consistent with some embodiments of the present disclosure may not be biased into a "clamped" state (whereas typical receptacles are); thus, insertion of a plug into a socket comprising such receptacles may advantageously require significantly less force and result in less wear and tear on both prongs of the plug and the receptacles of the socket.

Throughout this disclosure, reference is made to one or more possible "states" of both sockets and shields. As used herein, a socket is generally referred to as being in one of three possible socket states. A first socket state, referred to as an "unplugged and shielded" state, describes a state wherein a plug is not connected to a socket and at least one receptacle of the socket is at least partially shielded (meaning obscured, blocked, or otherwise covered) by a shield. A second socket state, referred to as an "unplugged and unshielded" state, describes a state wherein a plug is not connected to a socket but no receptacles are shielded. A third socket state, referred to as a "plugged" state, describes a state wherein a plug is connected to a socket (i.e., prongs of the plug are inserted into and in conductive contact with receptacles of the socket).

A "shield" is a physical barrier that prevents unwanted objects from entering into receptacles of a power socket. This advantageously increases safety of the power socket. As used herein, a shield is generally referred to as being in one of two shield positions. A first shield position, referred to as a "shielding" position, describes a position wherein the shield is at least partially obscuring, blocking, or otherwise covering at least one receptacle of a socket. A shield being in a "shielding" position implies that a socket is in an "unplugged and shielded" state. A second shield position, referred to as an "unshielding" position, describes a position wherein the shield does not cover the receptacles of the socket, meaning it does not physically prevent objects such as, for example, prongs of a plug, a paper clip, an eating utensil, etc. from being inserted into receptacles of a socket.

Throughout this disclosure, reference is made to components being "biased," particularly a socket magnet and shield of a socket. As used herein unless stated otherwise, "bias" refers to an equilibrium state or position of a component as a result of forces exerted upon the component by other components of the socket (i.e., excluding forces acting upon the component originating from sources external to the socket). For example, a magnet within a socket may be "biased" towards a first point by one or more forces (by, for example a spring), but a second, external magnet may be positioned such that the two magnets exert a magnetic attraction force on each other that overcomes the bias of the internal magnet, causing the first magnet to move away from the point towards which it is biased. Notably, as used herein, this does not affect the "bias" of the first magnet; even if the magnet is pulled by an overwhelming force away from the point or direction toward which it is said to be biased, it is still referred to as "biased" towards the point for purposes of this disclosure.

FIG. 1A illustrates a front view of a magnetic power socket 100 in an unplugged and shielded (or "safe") state consistent with several embodiments of the present disclosure. From the perspective of FIG. 1A, only a socket faceplate 101, receptacles 102A, 102B and 102C (collectively, "receptacles 102") and parts of shield 108 are visible. As shown in FIG. 1A, receptacles 102 are designed to accommodate plugs compatible with standards at least in the United States, but other configurations are possible. Shield 108 is depicted in a "shielding" position, as at least a portion of receptacles 102B and 102C are shielded. In other words, shield 108 acts as a physical barrier to prevent various unwanted objects from being entered into receptacles 102B and 102C. For example, shield 108 may block insertion of prongs of a plug, tools, silverware, and the like, advantageously increasing safety. When a magnetic plug is brought near to socket 100, shield 108 may automatically slide out of the way, allowing access to receptacles 102 (and thus allowing insertion of the magnetic plug). When no strong magnets are near socket 100, shield 108 may automatically slide back into the shielding position, returning socket 100 to the shielded and/or "safe" state. The specific nature of how socket 100 may be configured to automatically move shield 108 between shielding and unshielding positions is discussed in further detail below.

Figure 1B:
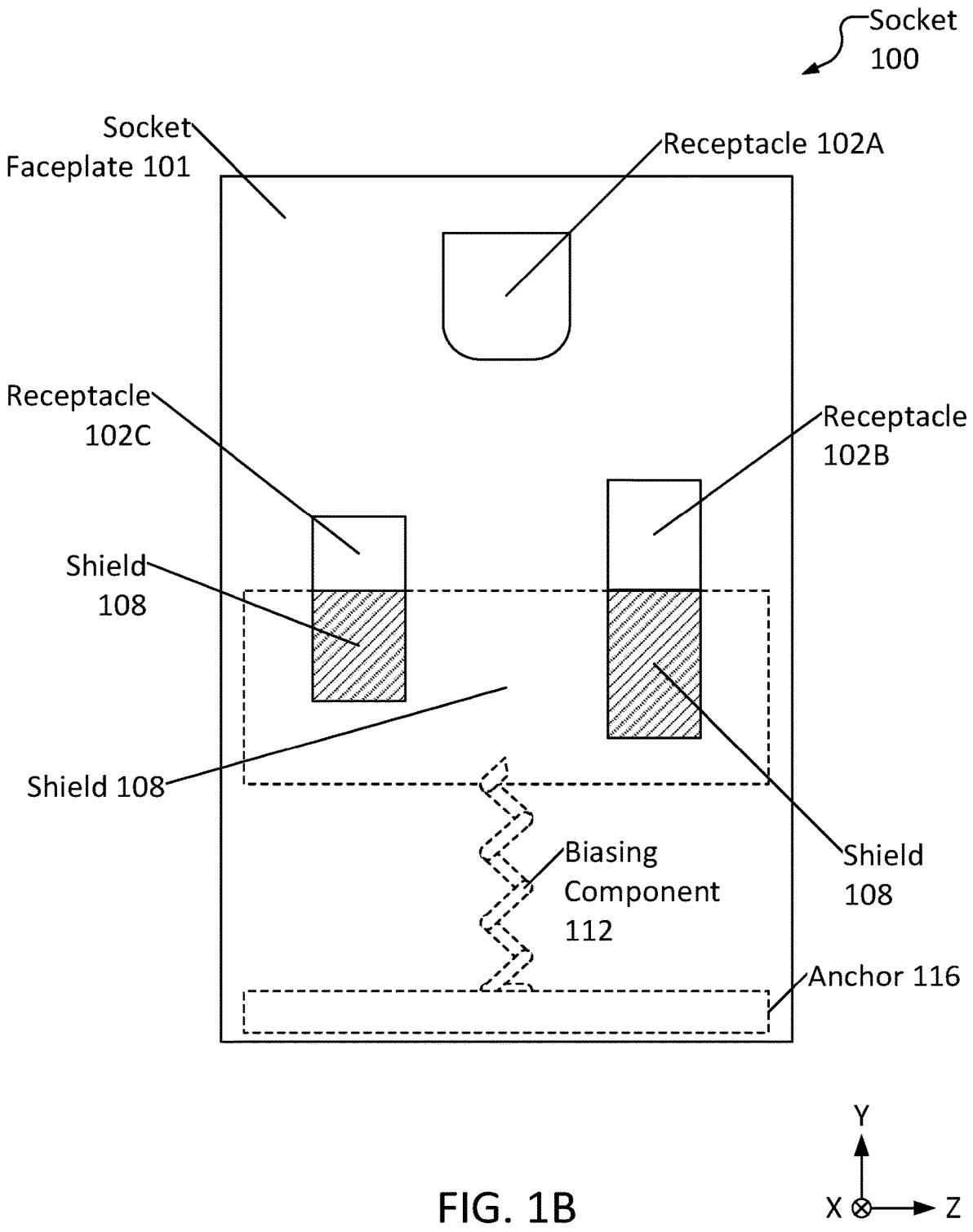
FIG. 1B illustrates a front view of a magnetic power socket in an unplugged and shielded (or "safe") state with outlines of some internal components shown consistent with several embodiments of the present disclosure.

FIG. 1B illustrates a front view of magnetic power socket 100 in an unplugged and shielded (or "safe") state with outlines of some internal components shown consistent with several embodiments of the present disclosure. More specifically, FIG. 1B shows an outline of shield 108, biasing component 112, and anchor 116. Shield 108 is biased into the shielding position via, at least in part, biasing component 112. Biasing component 112 may comprise, for example, a spring, with a first (lower) end coupled to anchor 116 and a second (upper) end coupled to shield 108. Thus, if shield 108 is pressed downward (in the negative Y direction) out of the shielding position, spring 112 is compressed and may exert an upward force on shield 108, pressing shield 108 back towards the shielding position.

Figure 2:
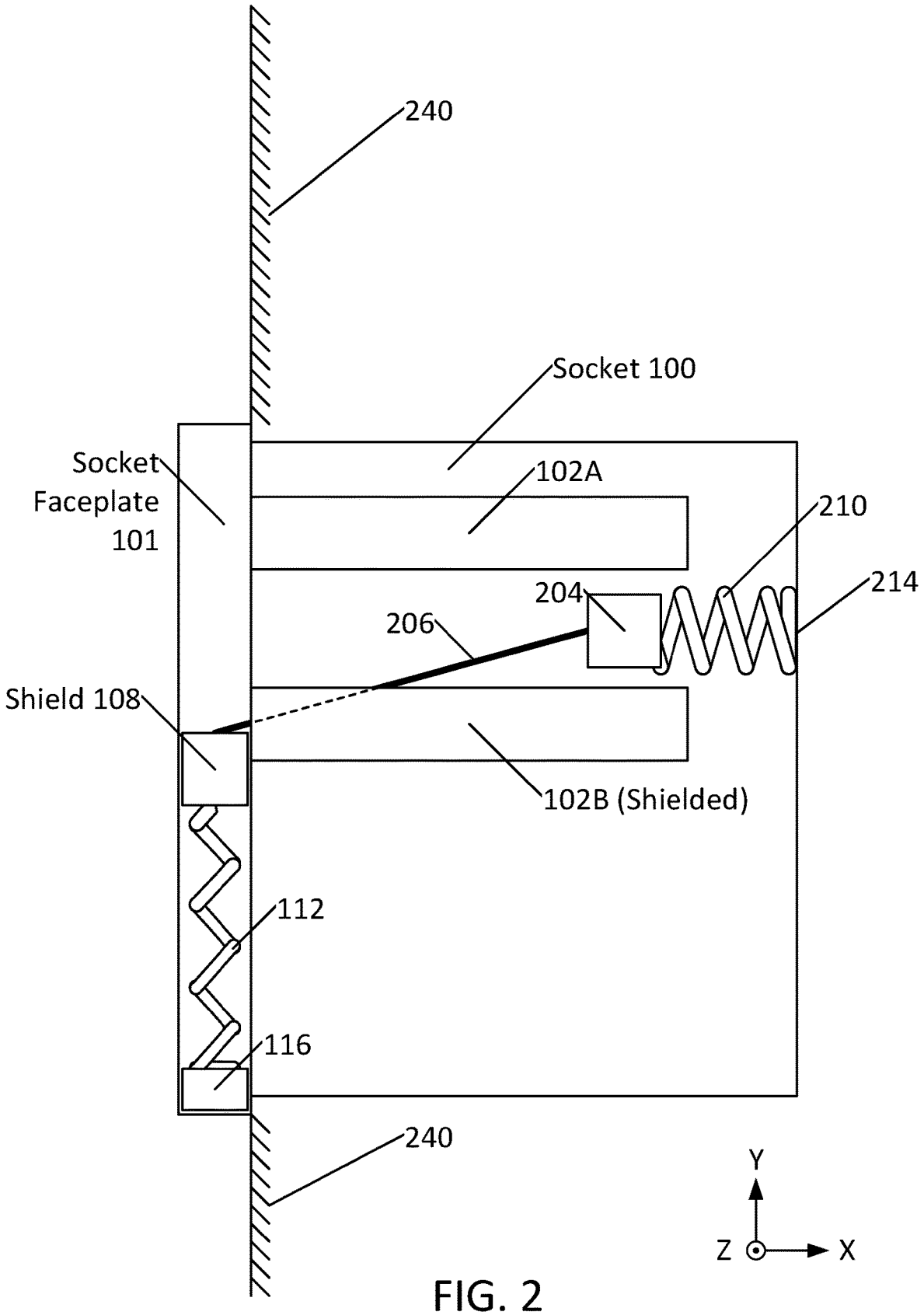
FIG. 2 illustrates a side view of a magnetic power socket installed in a wall, where the socket is in an unplugged and shielded (or "safe") state consistent with several embodiments of the present disclosure.

FIG. 2 illustrates a side view of magnetic power socket 100 installed in a wall 240, where the socket is in an unplugged and shielded (or "safe") state consistent with several embodiments of the present disclosure. As shown in FIG. 2, socket 100 further includes socket magnet 204, operably coupled to shield 108 via connector 206. Socket magnet 204 is biased toward a first position (for example, in a first direction toward anchor 214) by, for example, biasing component 210. Socket magnet 204 is movable between a first socket magnet position (for example, a relative maximum x-position, or a position sufficiently far to the right so as to hold shield 108 in the "shielding" position) and a second socket magnet position (for example, a relative minimum x-position, or a position sufficiently far to the left so as to hold shield 108 in the "unshielding" position). Shield 108 is biased in a second direction (for example, into the "shielding" position). This is due to a combination of forces exerted on shield 108 by biasing component 112 and socket magnet 204. Socket magnet 204 exerts a force on shield 108 because socket magnet 204 is biased towards a position by biasing component 210, which causes socket magnet 204 to exert a force on connector 206, which in turn causes connector 206 to exert a force on shield 108. For example, in some embodiments, biasing component 210 pulls socket magnet 204 to the right (in a "positive x-direction") and biasing component 112 pushes shield 108 up (in a "positive y-direction"). However, socket magnet 204 and shield 108 are connected via connector 206 such that moving socket magnet 204 may result in movement of shield 108 (i.e., out of or back into the shielding position).

Notably, the specific force exerted by biasing component 210 on socket magnet 204 and the specific force exerted by biasing component 112 on shield 108 may vary. For example, in some embodiments, biasing component 210 may "push" on socket magnet 204 (i.e., apply a force to the left or in the negative x-direction on socket magnet 204), but shield 108 may still be biased into the shielding position by, for example, biasing component 112. In other words, biasing components 210 and 112 may "oppose" each other; while this may not necessarily be preferable, shield 108 may still be biased into the shielding position as a net result of their contributions. For example, if both biasing components 210 and 112 comprise springs, shield 108 may be biased into the shielding position even if spring 112 exerts an opposing (e.g., downward) force on shield 108; in such an example, spring 210 may pull socket magnet 204 to the right with a significantly stronger force such that the corresponding upward force connector 206 exerts on shield 108 overcomes the relatively weak downward force spring 112 exerts on shield 108. Note that "bias" refers to the overall equilibrium position of shield 108 and/or socket magnet 204 resulting from biasing components 210 and 112; if, for example, a weak spring 210 pushes socket magnet 204 to the left and a strong spring pushes shield 108 upward such that socket magnet's 204 equilibrium position is at a relative maximum x-position (in spite of spring 210's force), socket magnet 204 is still referred to herein as "biased to the right."

For example, biasing component 210 may either pull socket magnet 204 to the right or push socket magnet 204 to the left. Similarly, biasing component 112 may either pull shield 108 down or push shield 108 up. However, when their effects are combined (via connector 206), the end result is that shield 108 is biased into the shielding position (discounting forces originating outside of socket 100).

Biasing components 210 and 112 may comprise, for example, a spring, a stretchable material (such as rubber), and the like. Biasing components 210 and 212 are not necessarily the same type of component; for example, biasing component 210 may comprise a stretchable material while biasing component 212 may comprise a spring.

In some embodiments, one of biasing components 210 or 112 may be omitted. For example, if biasing component 112 is omitted, shield 108 may still be biased into the shielding position due to biasing component 210's effect on socket magnet 204. For ease of discussion, biasing components 210 and 112 will be referred to throughout this disclosure as "springs." Where the term "spring" is used, it is assumed to refer to a spring or other type of biasing component that is consistent with the purpose and nature of the embodiment being discussed.

It is appreciated that springs are generally capable of pushing or pulling towards an equilibrium point. However, for ease of discussion, elements of socket 100 are described herein as being biased in a particular direction (e.g., to the right, in a positive x-direction, upward, in a positive y-direction, etc.) by biasing components 210 and 112 (which may comprise springs). As will be appreciated by one of ordinary skill in the art, where an element of socket 100 (such as, for example, socket magnet 204) being biased in a particular direction is discussed, it is assumed to refer to being biased towards an equilibrium point disposed in that particular direction. For example, a statement that socket magnet 204 is biased to the right refers to socket magnet 204 being biased towards an equilibrium point, where that equilibrium point is located to the right of socket magnet 204.

It is fully appreciated that, in some embodiments, it may be possible for an element to translate "past" the equilibrium point, in which instance it may be biased in an opposite direction. For example, in some embodiments wherein biasing components 210 and 112 are springs, it may be possible for socket magnet 204 to move "too far" to the right, in which case spring 210 may exert a force on socket magnet 204 to the left. This may occur, for example, if spring 112 is significantly stronger than spring 210. Regardless, spring 210 still anchors socket magnet 204 toward anchor 214, so socket magnet 204 is still considered "biased to the right."

In some embodiments, anchor 214 may comprise a component of a wall in which socket 100 is installed. In some embodiments, anchor 214 comprises a back surface of socket 100. Similarly, depending upon embodiment, anchor 116 may comprise a floor, a lower portion of socket 100 or faceplate 101, etc.

While FIG. 2 depicts shield 108, spring 112 and anchor 116 as being within faceplate 101, in some embodiments these components may be disposed further within socket 100, possibly even within wall 240. In some embodiments, socket 100 may not include its own faceplate 101.

As shown socket magnet 204 is biased via spring 210 in a first direction toward anchor 214. For ease of description, this first direction is referred to herein as a "positive x-direction," meaning parallel to an X-axis. Thus, in embodiments wherein socket 100 is installed in a wall (for example, to act as a wall power outlet), the positive x direction may be perpendicular to the plane of the wall, meaning socket magnet 204 is biased "deeper" into the wall, away from a front face of socket 100. Socket magnet 204 may comprise a "permanent" magnet (such as, for example, a neodymium magnet) or an electromagnet.

Shield 108 is biased via elements of socket 100 (including at least spring 112) into a "shielding" position. For ease of description, this is referred to as shield 108 being biased in a second direction, also referred to herein as a "positive y-direction," meaning parallel to a Y-axis. As used herein, the x and y axes are relative to the socket. Thus, in embodiments wherein socket 100 is installed in a floor, the positive y direction may be perpendicular to a gravitational force.

In some embodiments, socket 100, connector 206 and biasing components 210 and 112 are configured such that, as socket magnet 204 translates in the positive or negative x-direction, shield 108 translates in the positive or negative y-direction, respectively. Thus, shield 108 is movable, in that it can be moved by exerting a force on socket magnet 204. Further, shield 108 is designed to physically prevent objects external to socket 100 from making contact with one or more of receptacles 102 while shield 108 is in a first position. This first position of the shield is referred to herein as the "shielding" position. As described above, when shield 108 is in the shielding position, socket 100 is referred to herein as being in the "unplugged and shielded" or "safe" state.

Since socket magnet 204 is biased in the positive x-direction, shield 108 is biased to be in the "shielding" position. Further, applying a strong-enough magnetic force to socket magnet 204 would translate socket magnet 204 in the negative x-direction, causing shield 108 to be moved away toward an "unshielding" position, enabling access to the one or more previously shielded receptacle(s) 102. Thus, placing a plug (such as, for example, plug 520 of FIG. 5) that includes a magnet of sufficient strength (such as, for example, plug magnet 524 of FIG. 5) near socket magnet 204 may move socket magnet 204 in the negative x-direction, moving shield 108 from a "shielding" position to an "unshielding" position.

Thus, placing the plug near socket 100 may change socket 100 from an "unplugged and shielded" state to an "unplugged and unshielded" configuration. This may enable prongs of the plug (such as, for example, prongs 522 of FIG. 5) to be inserted into and make contact with receptacles 102, placing socket 100 into a "plugged" state and thus conductively connecting a device to a power supply. Further, when the plug is unplugged from socket 100, the magnetic force exerted on socket magnet 204 is reduced as the plug is moved away, eventually being reduced to a negligible force. As the plug is moved farther away, socket magnet 204 naturally translates back in the positive x-direction (due to the combination of spring 112, spring 210, and connector 206 overcoming the now-negligible magnetic force), resulting in shield 108 translating back into the "shielding" position. Thus, the simple act of preparing to insert the plug into socket 100 reconfigures socket 100 into an "unplugged and unshielded" state, and the act of removing the plug from socket 100 reconfigures socket 100 into an "unplugged and shielded" or "safe" state.

Socket magnet 204 is configured to be pulled in the negative x-direction when an external magnet of sufficient strength is brought near. However, if socket magnet 204 is able to translate enough to make physical contact with the external magnet, the attractive force may become so strong at to make separation of the two magnets difficult. Thus, in some embodiments, socket 100 includes a barrier (not shown) to prevent socket magnet 204 from directly contacting another magnet (such as, for example, plug magnet 524 of FIG. 5).

In some embodiments, shield 108 may be mounted on a track or pressed up against a surface (not shown) of socket 100 to prevent it from translating in the X-Z plane. However, in some embodiments, rather than translating along the Y axis, a portion of shield 108 may be pinned to enable shield 108 to rotate about an axis of rotation, where the axis of rotation is substantially parallel to the X axis. Thus, shield 108 may be moved into and out of a "shielding" position via rotation (still caused by translation of socket magnet 204 via connector 206), rather than translation.

Connector 206 is configured to cause socket magnet 204 and/or shield 108 to translate depending upon one another. For example, as socket magnet 204 translates in the positive x-direction, connector 206 exerts a force on shield 108 in the positive y-direction. In some embodiments, connector 206 may comprise a rigid member (for example, a bar, a strut, etc.), such that motion in any direction of either socket magnet 204 or shield 108 results in connector 206 exerting a corresponding force on the other. For example, moving socket magnet 204 to the right causes connector 206 to exert a corresponding upward force on shield 108. Similarly, moving shield 108 down causes connector 206 to exert a corresponding leftward force on socket magnet 204. In some embodiments, connector 206 may comprise a relatively thin plate.

In some embodiments, connector 206 may comprise a string, cable, rope, or similar structure, such that connector 206 may exert a pulling force on socket magnet 204 (i.e., in the negative x-direction) if shield 108 translates in the negative y-direction or may exert a pulling force on shield 108 (i.e., in the positive y-direction) if socket magnet 204 translates in the positive x-direction. However, a "string" embodiment of connector 206 may not exert any substantial force on shield 108 as socket magnet 204 translates in the negative x-direction (because the string would simply slacken). Similarly, a string embodiment of connector 106 may not exert any substantial force on socket magnet 204 as shield 108 translates in the positive y-direction.

In some embodiments, socket 100 may include additional receptacles 102. In some embodiments, socket 100 may include fewer receptacles 102. For example, in some embodiments socket 100 may only include receptacles 102B and 102C. Number, shape, orientation and position of receptacles 102 may vary depending upon local power outlet and cable standards.

Figure 3A:
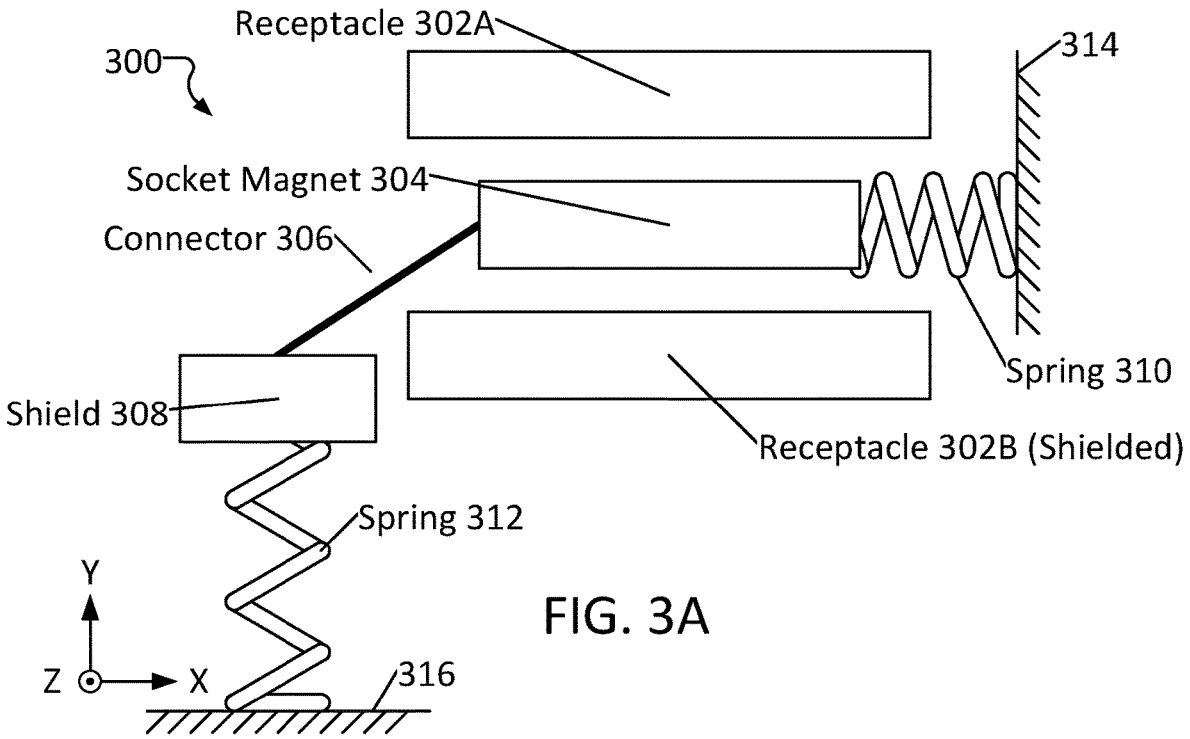
FIG. 3A illustrates a side view of the internal components of a magnetic power socket in an unplugged and shielded (or "safe") state consistent with several embodiments of the present disclosure.

FIG. 3A illustrates a side view of the internal components of a magnetic power socket 300 in an unplugged and shielded (or "safe") state consistent with several embodiments of the present disclosure. Socket 300 includes receptacles 302A, 302B and 302C (collectively "receptacles 302," though 302C is not visible in FIG. 3A), socket magnet 304, spring 310 (connected at a first end to anchor 314 and at a second end to socket magnet 304), shield 308, spring 312 (connected at a first end to anchor 316 and at a second end to shield 308), and connector 306 (operably coupling shield 308 to socket magnet 304).

Springs 310 and 312 exert forces on socket magnet 304 and shield 308, respectively, such that shield 308 is biased by components of socket 300 into a "shielding" position in the absence of other non-negligible forces (such as a magnetic attraction force from a nearby external magnet). When shield 308 is in the shielding position, at least receptacles 302B and 302C are at least partially covered. In some embodiments, shield 308 may fully cover one or more of receptacles 302 while shield 308 is in the shielding position. As shield 308 is biased into the shielding position, if shield 308 is moved (i.e., into a different "unshielding" position), forces exerted upon shield 308 as a result of springs 310 and 312 will act upon shield 308 so as to push shield 308 back into the shielding position.

Figure 3B:
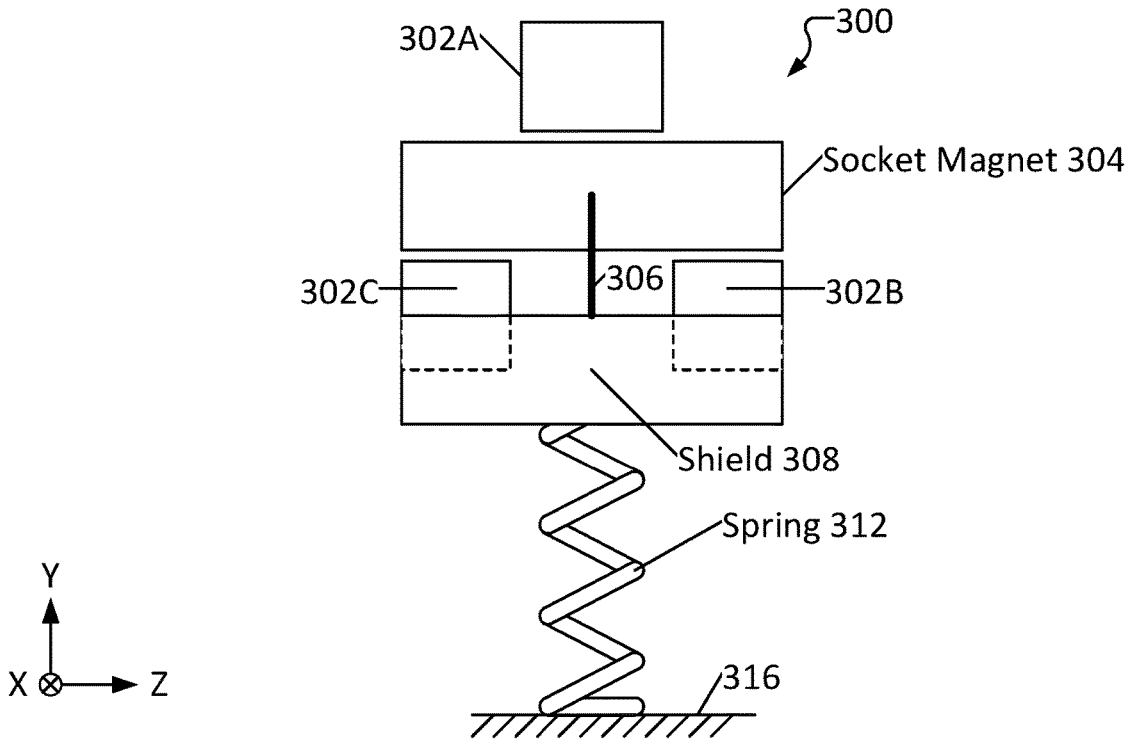
FIG. 3B illustrates a front view of the internal components of a magnetic power socket in an unplugged and shielded (or "safe") state consistent with several embodiments of the present disclosure.

FIG. 3B illustrates a front view of the internal components of a magnetic power socket 300 in an unplugged state consistent with several embodiments of the present disclosure. As can be seen from FIG. 3B, shield 308 in the "shielding" position covers or shields a portion of receptacles 302B and 302C such that unwanted objects are prevented from being entered into the receptacles. In some embodiments, shield 308 may cover receptacle 302A instead or in addition to 302B and 302C. As mentioned above, in some embodiments, shield 308 may fully cover one or more receptacles 302 instead of merely partially. As will be appreciated by one of ordinary skill in the art, different embodiments of socket 300 are contemplated which comply with different local outlet standards and/or laws. For example, receptacle 302A may be have a "half-rounded-rectangle" shape in North American regions, and rectangular in others. In China, shield 308 may cover at least part of both receptacles 302B and 302C, but other regions may not require shield 308 to cover both. As shown in FIG. 3B, connector 306 connects socket magnet 304 to shield 308.

Figure 4A:
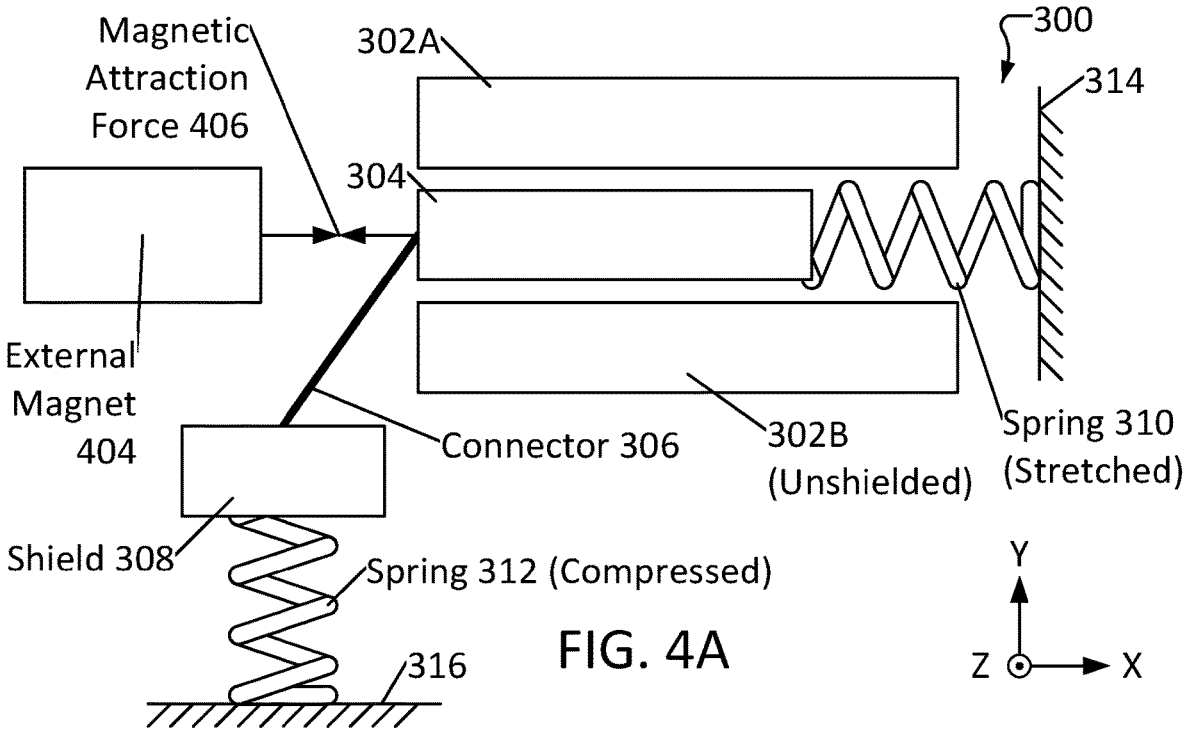
FIG. 4A illustrates a side view of the internal components of a magnetic power socket in an unshielded state when an external magnet is near the socket consistent with several embodiments of the present disclosure.

FIG. 4A illustrates a side view of the internal components of a magnetic power socket 300 in an unshielded state when an external magnet 404 is near the socket consistent with several embodiments of the present disclosure. As can be seen in FIG. 4A, when external magnet 404 is near socket magnet 304, a magnetic attraction force 406 between magnets 304 and 404 exists. Depending upon how close magnets 304 and 404 are to each other and their magnetic strengths, magnetic attraction force 406 may be sufficient to overcome the biasing forces of the other socket components (for example, those exerted by springs 310 and 312). If this happens, socket magnet 304 may be pulled in the negative x-direction out of its equilibrium/"biased" state. As socket magnet 304 translates to the left, it presses on connector 306, which in turn applies a downward force onto shield 308, pushing shield 308 away from the shielding position. In the example shown in FIG. 4A, this movement is achieved via translation in the negative Y direction.

Figure 5:
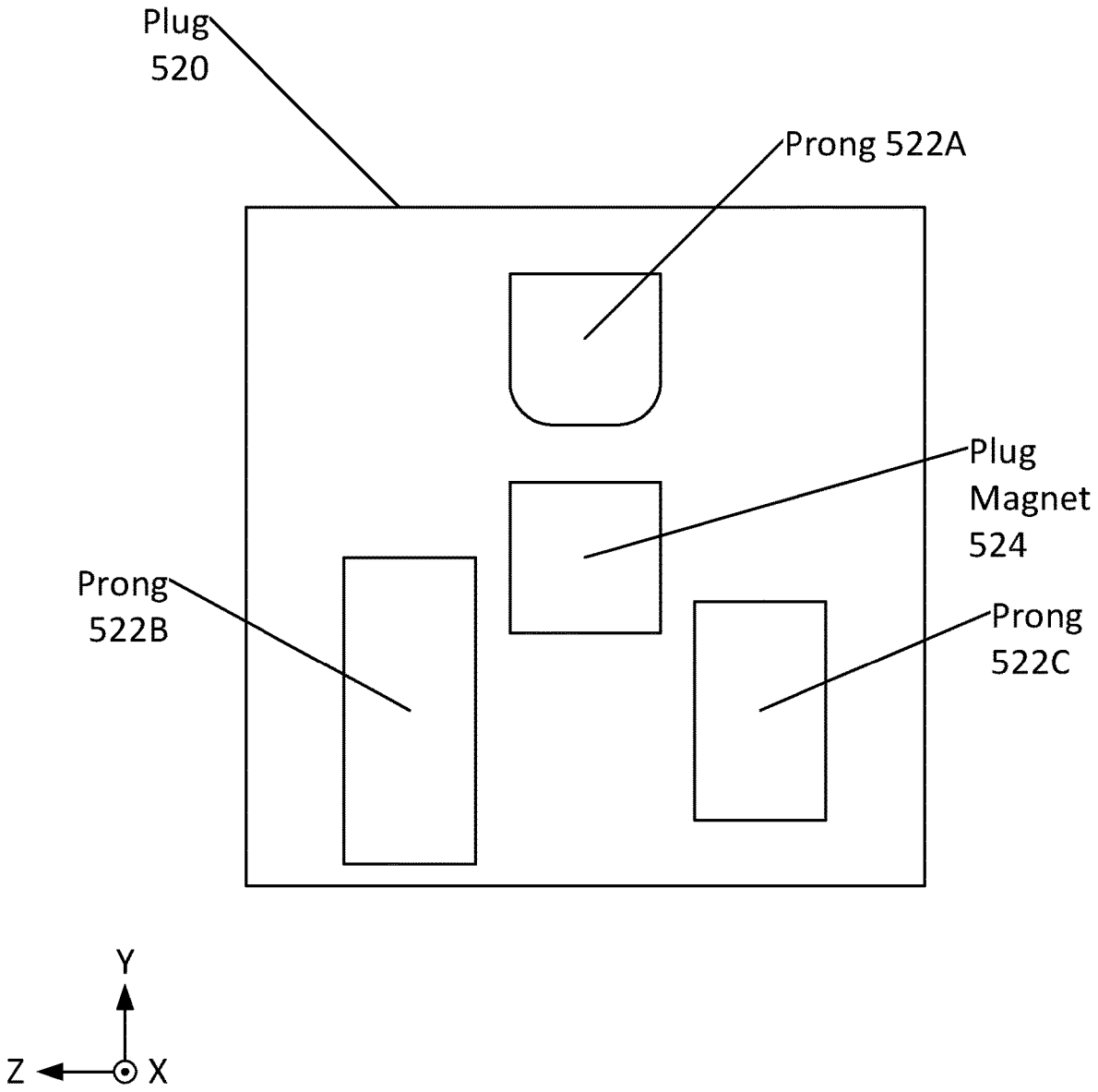
FIG. 5 illustrates a magnetic power plug according to an embodiment of the present disclosure.

With shield 308 in an "unshielding" position, receptacles 302 are exposed, allowing objects such as prongs of a plug to be inserted. Further, if external magnet 404 is contained within a plug (such as plug magnet 524 of plug 520 as depicted in FIG. 5), then when the plug is fully inserted into socket 300, magnets 304 and 404 may be at a relative minimum distance from each other. Thus, when the plug is completely inserted into the socket, magnetic attraction force 406 is at a maximum, resulting in a "locking" effect and inhibiting accidental removal of the plug from socket 300. Note that, even in this state (where socket magnet 304 is pulled and held to the left), as the magnetic attraction force 406 is an external force (originating from a component external to socket 300, such as external magnet 404), socket magnet 304 is still described as "biased" to the right or in the positive X-direction because the components internal to socket 300 act to move socket magnet 304 to the right. Similarly, shield 308 is still described as being "biased" into the "shielding" position, even if shield 308 may be pulled and held in the negative Y-direction.

In this unshielded state of socket 300, spring 312 may be compressed and spring 310 may be extended. Thus, this state is generally unstable, in that without an external force (such as magnetic attraction force 406), springs 310 and 312 would naturally exert forces to return socket magnet 304 and shield 308 to their previous positions depicted in FIGS. 3A and 3B, returning socket 300 to an unplugged and shielded (or "safe") state.

Figure 4B:
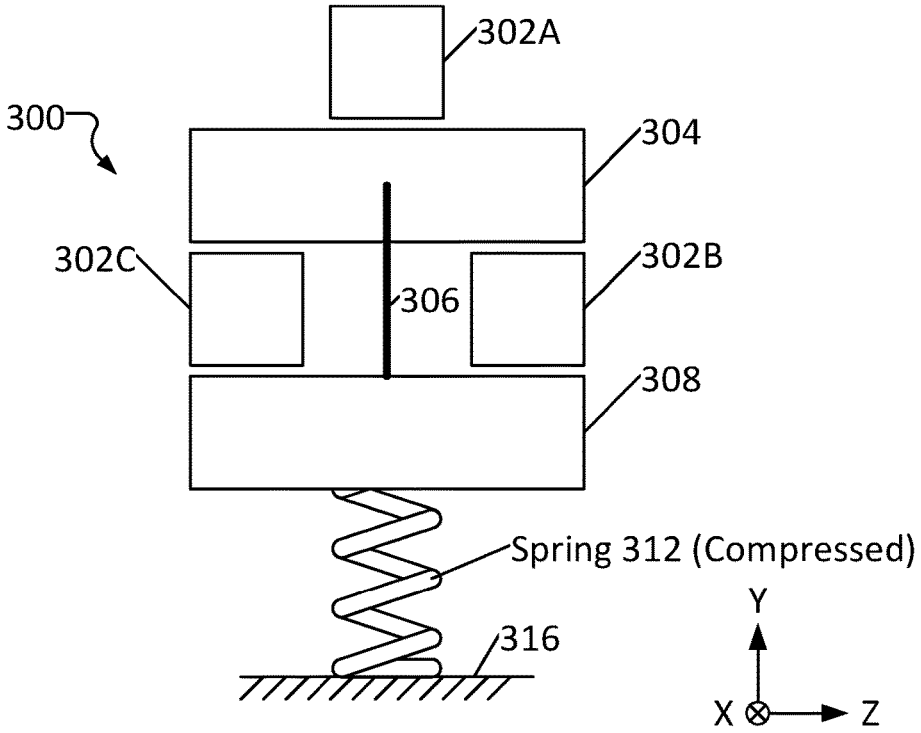
FIG. 4B illustrates a front view of the internal components of a magnetic power socket in an unshielded state consistent with several embodiments of the present disclosure.

FIG. 4B illustrates a front view of a magnetic power socket 100 in an unshielded state consistent with several embodiments of the present disclosure. As shown in FIG. 4B, when shield 308 is in the "unshielding" position, receptacles 302B and 302C are (fully) exposed. In other words, when shield 308 is in the unshielding position, shield 308 does not cover receptacles 302B or 302C, meaning that objects such as prongs of a plug can be inserted into them. Since all of receptacles 302 are exposed in this state, a plug (such as plug 520 of FIG. 5) can be inserted and electrically connected to socket 300. As described above, socket 300 is naturally biased to return to an unshielded (or "safe") state, returning shield 308 to the "shielding" position and covering or blocking off at least a portion of some of receptacles 302 (in this example, receptacles 302B and 302C). However, if objects are inserted into receptacles 302 (such as prongs 522 of FIG. 5), these objects may physically prevent shield 308 from returning to the "shielding" position. Thus, if a plug is connected to socket 300 while socket 300 is in a plugged state such that prongs are inserted into receptacles 302, the plug itself would remain connected, but once the plug is disconnected (and thus the prongs are removed from receptacles 302), socket 300 would naturally return to an unplugged and shielded (or "safe") state, advantageously increasing safety.

The layout of receptacles 302 of socket 300 as depicted in FIGS. 3A, 3B, 4A and 4B is not meant to be limiting; other layouts compatible various standards for sockets as defined by various nations or regions are fully contemplated herein. For example, socket 300 could be configured to be compatible with the "half-rounded rectangle ground and parallel rectangular hot/neutral" plugs of North America (such as plug 520 of FIG. 5), the "three rectangular" receptacles of China (such as plug 720 of FIG. 7), etc. In some embodiments, placement of receptacles 302 and/or requirements of local legislation may require disposing socket magnet 304 and/or shield 308 in different positions or orientations than those depicted in FIGS. 3A, 3B, 4A and 4B.

FIG. 5 illustrates a detailed view of a magnetic power plug 520 according to an embodiment of the present disclosure. Plug 520 includes prongs 522A, 522B and 522C (collectively, "prongs 522"). Plug 520 also includes at least one plug magnet 524. Plug magnet 524 is disposed such that it is magnetically attracted to a magnet of a socket (such as, for example, socket magnet 204 of socket 100, socket magnet 304 of socket 300, etc.) when plug 520 is plugged into the socket. As plug 520 is brought near to the socket, plug 520 is naturally guided into place (i.e., prongs 522 are guided into corresponding receptacles) and a shield of the socket may be moved into an "unshielding" position. In some embodiments, plug magnet 524 is embedded within plug 520 or otherwise covered with a non-magnetic insulating layer. This may prevent plug magnet 524 from making direct physical contact with another magnet (which otherwise may result in the magnets being difficult to separate).

In some embodiments, plug 520 may include one or more plug-supporting magnets (not shown) positioned to align with corresponding socket-supporting magnets on or within a socket when plug 520 is oriented appropriately (i.e., to enable prongs 522 to enter receptacles such as receptacles 102). These supporting magnets may serve to help guide and/or keep plug 520 into the appropriate orientation. Supporting magnets may have an opposite orientation (with respect to magnetic polarity, i.e. North/South) as plug magnet 524 to prevent plug magnet 524 from pulling on the supporting magnets.

Plug 520 may be advantageously simple to use with a socket such as, for example, socket 100. However, plug 520 may not be restricted to use with correspondingly-designed sockets; rather, in some embodiments plug 520 may be fully compatible with typical existing sockets. In some use cases, for example, sockets without a socket magnet and/or socket supporting magnets may still accept plug 520, retain prongs 522 and conduct electricity as with any other plug. However, use of plug 520 with a typical socket (i.e., one lacking socket magnet(s)) may suffer the same disadvantages as use of a typical plug. In other words, a user may have more difficulty plugging plug 520 into a typical socket than into a magnetically-enabled socket such as socket 100, though no more than when plugging a typical plug into the typical socket.

Plug 320 is depicted as having prongs 322 in a configuration compatible with sockets of, for example North America. However, embodiments including different prong layouts, such as those compatible with sockets based on standards of other nations or regions, are fully contemplated herein. For example, plug 520 of FIG. 5 may have prongs 522 compatible with sockets in the United Kingdom, China, etc.

Figure 6A:
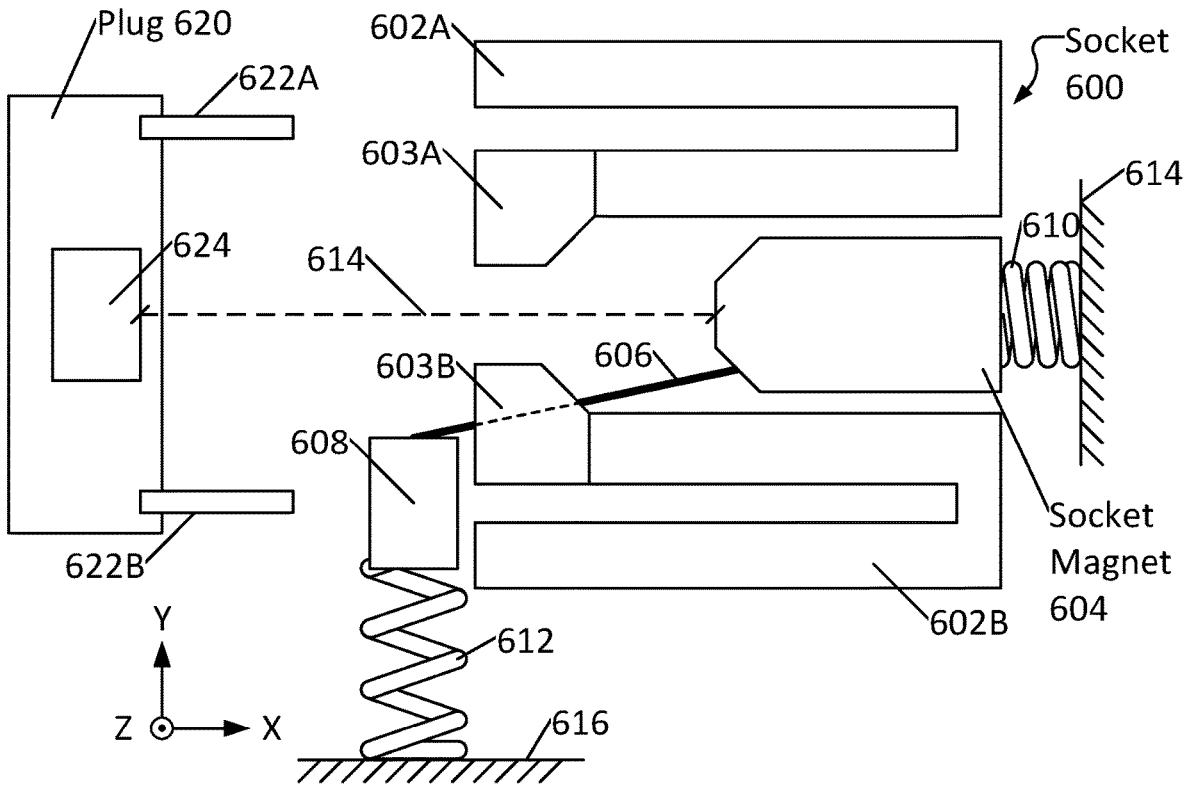
FIG. 6A illustrates a side view of a magnetic power socket and plug system in an unplugged and shielded state consistent with one embodiment of the present disclosure.

FIG. 6A illustrates a side view of a magnetic power socket 600 and plug 620 system in an unplugged and shielded state consistent with one embodiment of the present disclosure. Socket 600 includes two receptacles, 602A and 602B (collectively, "receptacles 602"). Receptacle 602A includes an interface segment 603A, and receptacle 602B includes an interface segment 603B. Interface segment 603A and interface segment 603B are collectively referred to herein as "interface segments 603." Socket 600 also includes socket magnet 604, biased in the positive x-direction via spring 610, and shield 608, biased in the positive y-direction via spring 612. When shield 608 is at a relative maximum y position, shield 608 covers or blocks access to receptacle 602B. This is referred to as a "shielded" state of socket 600.

Plug 620 includes prongs 622A and 622B (collectively, "prongs 622"), as well as plug magnet 624. Plug 620 and socket 600 are configured such that prongs 622 may be inserted into receptacles 602 (for example, prong 622A may be inserted into receptacle 602A and prong 622B may be inserted into receptacle 602B). When prongs 622 make contact with contacts of receptacles 602, electricity is conducted between prongs 622 and the contacts of receptacles 602 (and thus, electricity is conducted between plug 620 and socket 600). This state, where prongs 622 are conductively coupled with receptacles 602, is referred to herein as a "plugged" state. A state where prongs 622 are not inserted into receptacles 602 (such as the state depicted in FIG. 4A) is referred to herein as an "unplugged" state, which, depending upon a position of shield 608, may further be referred to as a "shielded" or "unshielded" state. Thus, as FIG. 6A depicts shield 608 in the shielding position, FIG. 6A depicts a "shielded and unplugged" state.

While FIG. 6A illustrates interface segments 603 as wedge-shaped segments near tips of receptacles 602, other configurations and implementations are possible and are fully considered herein. For example, a lower surface of receptacle 602A may be sloped or curved, etc. Receptacles 602 are configured to receive prongs 622 of plug 620. Further, contacts of receptacles 602 are configured to be bendable so as to exert a force onto prongs 622 when plug 620 is plugged into socket 600 (i.e., while in a "plugged" state). For example, when plug 620 is plugged into socket 600, receptacles 602 are configured to "grip" or "pinch" prongs 622 to help hold prongs 622 in place within receptacles 602. This results in friction between receptacles 602 and prongs 622, helping to keep plug 620 plugged into socket 600. As described above, "receptacles" include both a contact surface and a negative space. Contacts of receptacles 602 at least partially comprise an electrically conductive material. Further, contacts of receptacles 602 may comprise a material such that they naturally "unbend" back to an original "unplugged" state (for example, a material with a relatively high modulus of elasticity) when receptacles 602 are "empty" (for example, if prongs 622 are removed from receptacles 602). In some embodiments, contacts of receptacles 602 comprise a layer of conductive material bonded to an elastic material (via, for example, adhesive, bindings, etc.).

Socket 600 is configured such that, as socket magnet 604 translates in the negative x-direction, a force is exerted on shield 608 in the negative y-direction, and vice versa (as magnet 604 translates in the positive x-direction, a force is exerted on shield 608 in the positive y-direction). Socket magnet 604 causes forces to be exerted upon shield 608 via one or more connectors 606. The one or more connectors 606 may be similar to connectors 106, 206, and/or 306 of FIGS. 1A-4B.

A position of plug 620 relative to socket 600 can be described in terms of distance 614 between socket magnet 604 and plug magnet 624. In the "unplugged and shielded" state depicted in FIG. 6A, plug magnet 624 is a relatively large distance 614 from socket magnet 604 (for example, greater than two inches) such that the magnetic attraction force between plug magnet 624 and socket magnet 604 is relatively small and/or negligible. Notably, in this state, the magnetic attraction force between these magnets is insufficient to overcome the force exerted upon socket magnet 604 by biasing spring 610 (and possibly a force exerted upon socket magnet 604 as a result of biasing spring 612). Thus, as long as distance 614 remains relatively large, socket magnet 604 remains in a relative maximum x-position, meaning shield 608 remains in a relative maximum y-position (i.e., a "shielding" position). This means that, as long as distance 614 remains relatively large, socket 600 remains in a "shielded" state, advantageously increasing safety by, for example, preventing foreign objects from being accidentally or intentionally inserted into at least receptacle 602B. Note that socket 600 may be configured to restrict a maximum y-position of shield 608 (such that shield 608 does not rise "past" the shielding position). This may be accomplished by, for example, a physical barrier (not shown in FIG. 6), selection of spring 612 (such that were shield 608 to extent too far, spring 612 would pull it back down in the negative y-direction), shape of shield 608, etc.

Figure 6B:
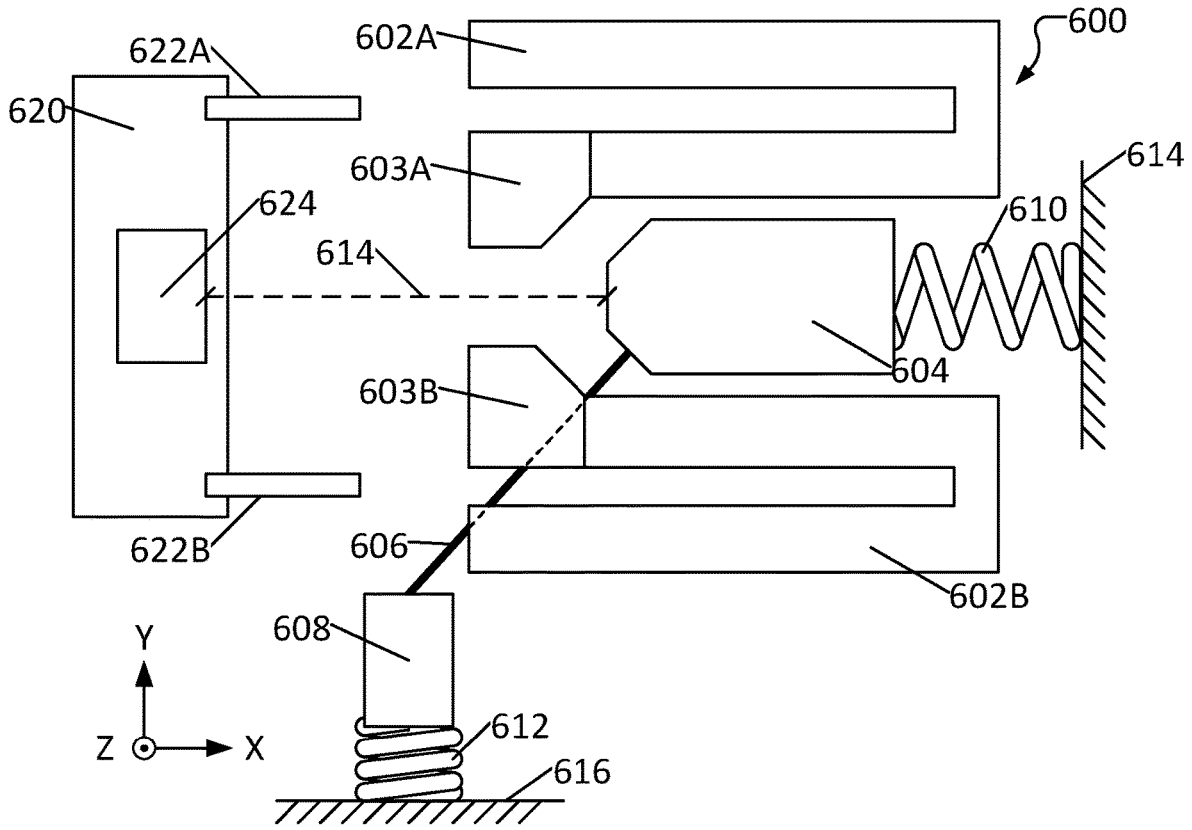
FIG. 6B illustrates a side view of a magnetic power socket and plug system in an unplugged and unshielded state consistent with one embodiment of the present disclosure.

FIG. 6B illustrates a side view of a magnetic power socket 600 and plug 620 system in an unplugged and unshielded state consistent with one embodiment of the present disclosure. Once distance 614 is reduced to be relatively small (for example, two inches or less), a magnetic attraction force between socket magnet 604 and plug magnet 624 is sufficient to overcome the biasing forces exerted on socket magnet 604 by biasing spring 610 (and by connector 606 as a result of shield 608 and biasing spring 612). Thus, socket magnet 604 begins to translate in the negative x-direction. This, as described above, results in a force being exerted on shield 608 (via connector 606), causing shield 608 to translate in the negative y-direction and therefore exposing receptacle 602B (this position of shield 608 is referred to as an "unshielding" position, and this state of socket 600 is referred to as an "unplugged and unshielded" state). Further, this increase in the magnetic attraction force acts upon plug magnet 624 (and thus plug 620) as well, advantageously aiding a user in inserting plug 620 into socket 600.

While in this "unshielded" position, forces on shield 608 are sufficient to overcome the "biasing" forces exerted on shield 608 resulting from biasing spring 612 and biasing spring 610, shield 608 is still described herein as being "biased" in the positive Y-direction. This is because, as described above, the term "biased" refers to an effect resulting from biasing components 610 and 612. Similarly, though socket magnet 604 may be pulled and held in the negative X-direction, socket magnet 604 is still described as "biased" in the positive X-direction.

Figure 6C:
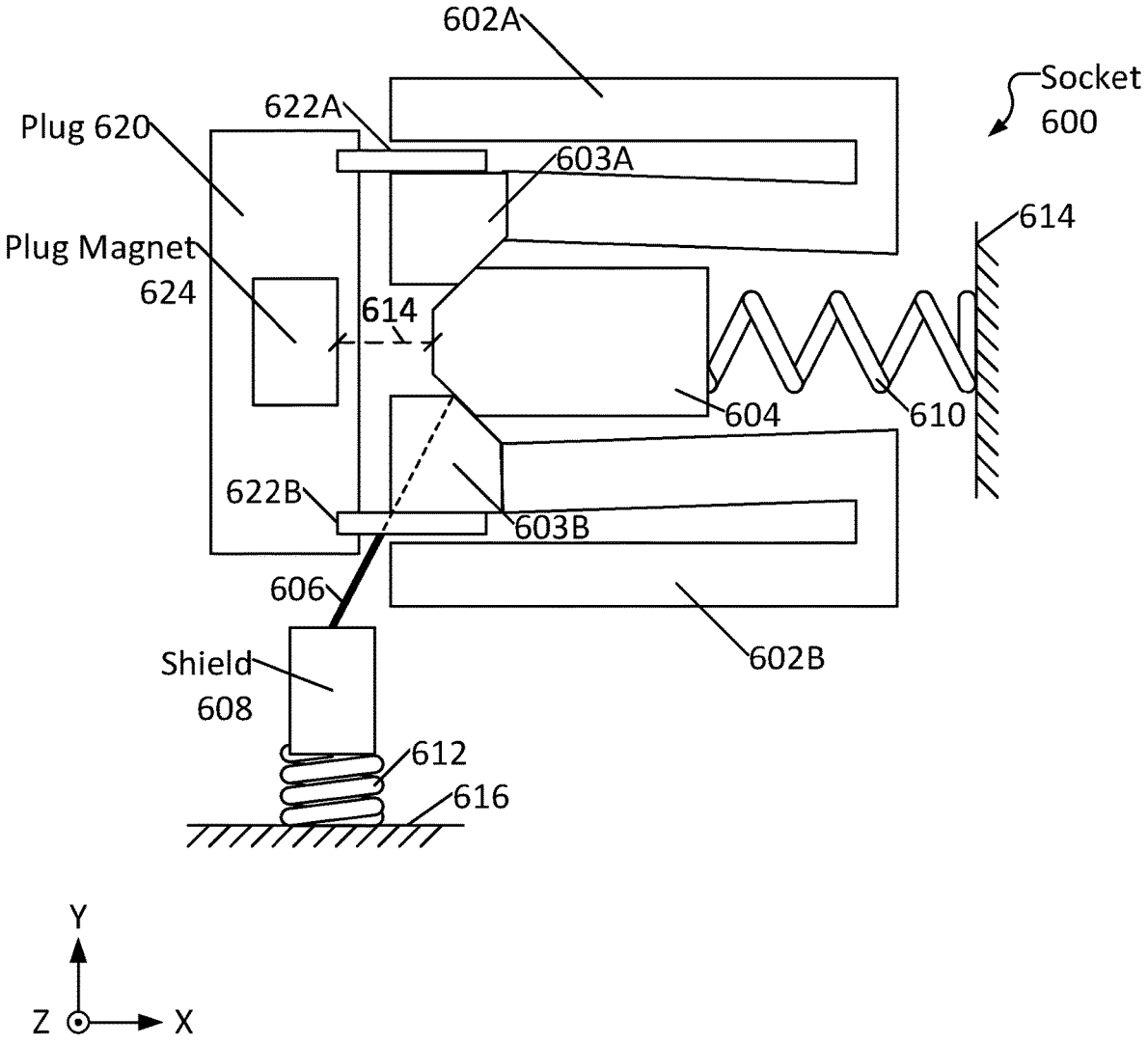
FIG. 6C illustrates a side view of a magnetic power socket and plug system in a plugged state consistent with one embodiment of the present disclosure.

FIG. 6C illustrates a side view of a magnetic power socket 600 and plug 620 system in a plugged state consistent with one embodiment of the present disclosure. As plug magnet 624 and socket magnet 604 are brought together and thus as prongs 622 are inserted into receptacles 602, distance 614 is at a relative minimum, thus increasing the magnetic attraction force between the magnets 624 and 604. Further, socket magnet 604 is configured to contact and push on contact surfaces 603 of receptacles 602, causing contacts of receptacles 602 to bend as described above. As the contacts of receptacles 602 (including interface segments 603) bend, they make contact with prongs 622, which may provide electrical conductivity and/or increased retention force. Note that, in some embodiments, prongs 622 may make electrically conductive contact with other areas of receptacles 602 (i.e., not solely with interface segments 603). In other words, while prongs 622 may be depicted as only contacting interface segments 603, dimensions of prongs 622, receptacles 602, and/or interface segments 603 etc. may vary depending upon embodiment such that prongs 622 may contact, for example, a back wall of receptacles 602, etc. FIG. 6C is merely an abstract representation of one example embodiment.

Depending upon strengths of magnets 604 and 624, once a user has partially inserted plug 620 into socket 600, socket magnet 604 may be pulled farther in the negative x-direction, increasing the magnetic attraction force and therefore assisting a user in inserting plug 620. This may result in a "locking" effect, where once plug 620 is fully inserted into socket 600, distance 614 is at a minimum and thus the magnetic attraction force between magnets 604 and 624 is at a maximum. In a typical plug and socket, the plug is retained within the socket via a clamping/friction effect that resists insertion as strongly as it resists removal. Since receptacles 602 are not biased into a "clamped" state (whereas typical receptacles are), insertion of plug 620 into socket 600 advantageously requires significantly less force and results in less wear and tear on both prongs 622 and receptacles 602. Further, while plug 620 may be much easier to insert into socket 600 than a normal plug and socket system, once plugged in, plug 620 may still be difficult enough to remove so as to prevent accidental unplugging.

This also means that if magnets 604 and 624 are extremely powerful, it may be particularly difficult to remove plug 620 from socket 600. However, a user only needs to overcome the magnetic attraction force enough to increase distance 614 past a certain threshold. When distance 614 is great enough (for example, greater than two inches), the biasing forces (stemming from spring 610 and/or 612) acting in the positive x direction on socket magnet 604 are stronger than the magnetic attraction force acting in the negative x-direction. Thus, once distance 614 is greater than this threshold, socket magnet 604 may be pulled/pushed back in the positive x-direction, further increasing distance 614 and therefore further reducing the magnetic attraction force. Thus, while typical plugs are retained via friction (requiring a relatively steady force to remove from a typical socket), plug 620 may resist removal from socket 600 only briefly before suddenly becoming advantageously easy to remove. This generally means that plug 620 may be more resistant to accidentally coming unplugged from socket 600 by being bumped, etc. (if the strength of magnets 604 and 624 are sufficient such that the net forces are stronger than typical friction-based retention forces). Further, if a user intends to unplug plug 620 from socket 600, while this action may require a greater initial force, once distance 614 is large enough, removing plug 620 becomes easier.

In some embodiments, receptacles 602 and interface segments 603 may comprise a material and/or be shaped such that the bend resistance of the contacts of receptacles 602 applies sufficient force (via interface segments 603) on socket magnet 604 in the positive x-direction so as to make spring 610 unnecessary. In other words, as an illustrative example, if receptacles 602 and interface segments 603 made a wedge shape such that the farther to the left socket magnet 604 is, the more bent receptacles 602 are. Thus, socket magnet 604 may be pressed toward the right (in the positive x-direction) simply by the contacts of receptacles 602 "trying to un-bend," which could suffice as a biasing force in lieu of a spring 610. In some embodiments, this wedging force may supplement a spring 610 rather than replace it.

Figure 7:
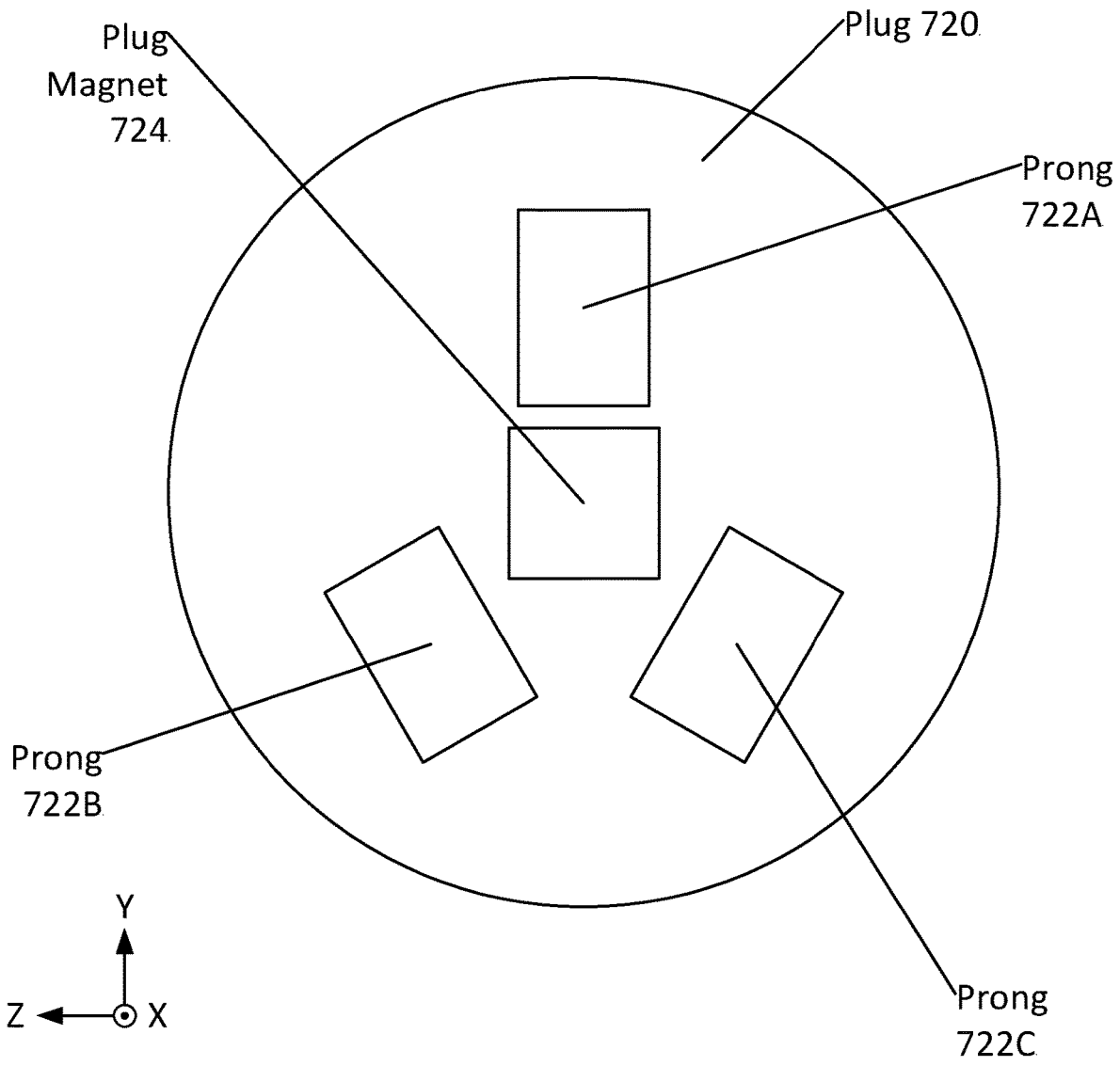
FIG. 7 illustrates a detailed view of a magnetic power plug compatible with standard Chinese power outlets according to an embodiment of the present disclosure.

FIG. 7 illustrates a detailed view of a magnetic power plug 720 compatible with standard Chinese power outlets according to an embodiment of the present disclosure. Plug 720 includes prongs 722A, 722B and 722C (collectively, "prongs 722"). Plug 720 also includes at least one plug magnet 724. As described above, while plug 520 may be compatible with sockets in the United States, prongs 722 are arranged such that plug 720 may be capable of plugging into standard sockets in China. Similar modifications may be made to sockets 100, 200 and/or 300 to be capable of accepting plug 720.

The descriptions of the various embodiments of the present disclosure have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A socket, comprising:

one or more receptacles;

a shield, wherein the shield is movable between a first shield position and a second shield position, wherein:

the shield at least partially covers at least one of the one or more receptacles while the shield is in the first shield position;

the shield exposes the at least one of the one or more receptacles while the shield is in the second shield position; and the shield is biased towards the first shield position; and a socket magnet operably coupled to the shield, wherein the socket magnet is movable between a first socket magnet position and a second socket magnet position, wherein:

moving the socket magnet to the first socket magnet position results in moving the shield to the first shield position;

moving the socket magnet to the second socket magnet position results in moving the shield to the second shield position; and the socket magnet is biased towards the first socket magnet position.

2. The socket of claim 1, further comprising one or more supporting magnets to magnetically attract a supporting magnet of an external plug.

3. The socket of claim 1, wherein the shield is configured to only be capable of translating along a first axis.

4. The socket of claim 1, wherein the socket magnet is configured to only be capable of translating along a second axis.

5. The socket of claim 1, wherein the shield at least partially covers a hot receptacle and a neutral receptacle when the shield is in the first shield position.

6. The socket of claim 1, wherein:

at least one of the one or more receptacles is a bendable receptacle, wherein the bendable receptacle is configured to be elastically bendable; and the bendable receptacle is configured to apply a retaining force to an inserted prong when in a bent state.

7. The socket of claim 6, wherein:

the bendable receptacle includes an interface segment; and the socket magnet is configured to apply a force to the interface segment and bend the at least one bendable receptacle.

8. A system, comprising:

a socket, the socket including:

one or more receptacles including one or more contacts;

a shield, wherein:

the shield is movable between a first shield position and a second shield position;

the shield at least partially covers at least one of the one or more receptacles while the shield is in the first shield position;

the shield exposes the at least one of the one or more receptacles while the shield is in the second shield position; and the shield is biased towards the first shield position; and a socket magnet operably coupled to the shield, wherein:

the socket magnet is movable between a first socket magnet position and a second socket magnet position;

moving the socket magnet to the first socket magnet position results in moving the shield to the first shield position;

moving the socket magnet to the second socket magnet position results in moving the shield to the second shield position; and the socket magnet is biased towards the first socket magnet position; and a plug, including:

one or more prongs, the prongs to conductively couple with the contacts; and a plug magnet configured to be magnetically attracted to the socket magnet when the plug is inserted into the socket.

9. The system of claim 8, wherein the shield is configured to only be capable of translating along a first axis.

10. The system of claim 8, wherein the socket magnet is configured to only be capable of translating along a second axis.

11. The system of claim 8, wherein the prongs are arranged to be compatible with one or more standardized electrical socket layouts.

12. The system of claim 8, wherein the shield at least partially covers a hot receptacle and a neutral receptacle when the shield is in the first position.

13. The system of claim 8, wherein:

the socket further comprises one or more socket supporting magnets;

the plug further comprises one or more plug supporting magnets; and the plug supporting magnets are configured to be magnetically attracted to the socket supporting magnets when the plug is inserted into the socket.

14. The system of claim 13, wherein:

the socket magnet has a first polarization;

the one or more socket supporting magnets have a second polarization; and the first polarization is opposite the second polarization.

15. The system of claim 8, wherein:

at least one of the one or more receptacles is a bendable receptacle, wherein the bendable receptacle is configured to be elastically bendable; and the bendable receptacle is configured to apply a retaining force to an inserted prong when in a bent state.

16. The system of claim 15, wherein:

the bendable receptacle includes an interface segment; and the socket magnet is configured to apply a force to the interface segment and bend the at least one bendable receptacle.

* * * * *